United States Patent [19]

Kreye

[11] Patent Number: 4,945,662

[45] Date of Patent: Aug. 7, 1990

[54] ATTACHMENT FOR TRACTOR

[76] Inventor: Luke Kreye, 125 Albemarle Ave., Hempstead, N.Y. 11550

[21] Appl. No.: 407,119

[22] Filed: Sep. 14, 1989

[51] Int. Cl.[5] ..... E02F 3/72

[52] U.S. Cl. ..... 37/103; 37/117.5; 37/118 R; 37/141 R; 37/DIG. 12; 414/723

[58] Field of Search ..... 37/117.5, 118 R, 141 R, 37/DIG. 3, DIG. 9, DIG. 10, DIG. 12, 103, 80 R, 118 A; 414/697, 722, 723, 724

[56] References Cited

U.S. PATENT DOCUMENTS

| | | | |
|---|---|---|---|
| 3,963,131 | 6/1976 | Dimmer | 414/697 |
| 4,117,944 | 10/1978 | Beckstrom et al. | 414/724 |
| 4,136,792 | 1/1979 | Wilson | 37/117.5 X |
| 4,279,566 | 7/1981 | Sagaser et al. | 414/694 X |
| 4,355,946 | 10/1982 | Wykhuis et al. | 414/707 |
| 4,476,641 | 10/1984 | Ballinger | 37/118 R |
| 4,545,721 | 10/1985 | Pettersson | 37/DIG. 3 X |
| 4,749,048 | 6/1988 | Kelly | 37/117.5 X |
| 4,812,103 | 3/1989 | Cochran et al. | 414/723 |

*Primary Examiner*—Dennis L. Taylor
*Assistant Examiner*—J. Russell McBee
*Attorney, Agent, or Firm*—Myron Amer

[57] ABSTRACT

An improved attachment for a tractor of the type having, in addition to a main hydraulic piston, an auxiliary hydraulic piston typically used in urging the scoop thereof in a pivotal traverse for "dumping" the contents of the scoop, in which the scoop is replaced with an inverted U-shaped bucket and the "dumping" pivotal traverse is used to advantage to achieve a backhoeing stroke, which stroke heretofore was only possible using a specially designed backhoeing attachment with multiple linkages and the like.

3 Claims, 2 Drawing Sheets

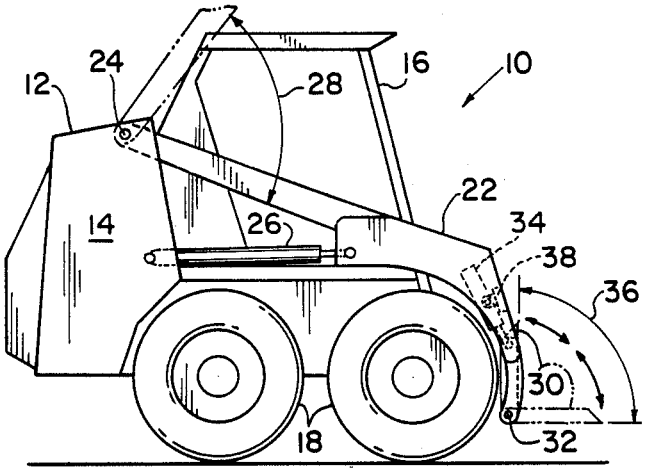
FIG.1
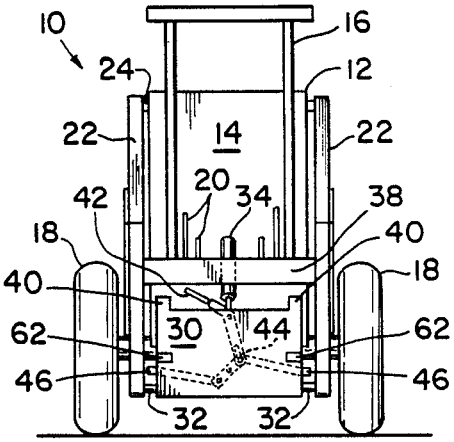
FIG.2
FIG.9
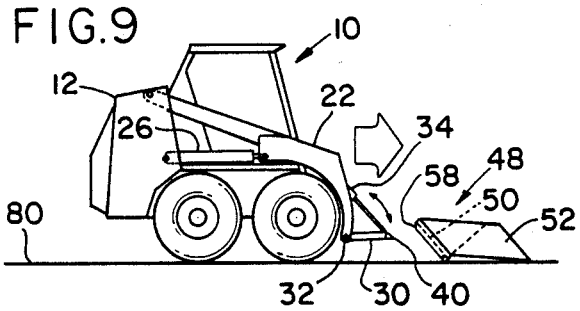
FIG.11
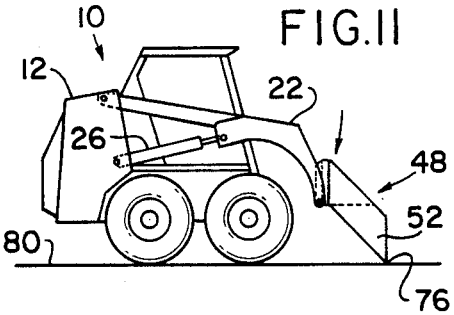
FIG.10
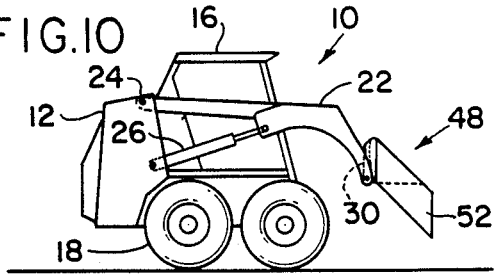
FIG.12
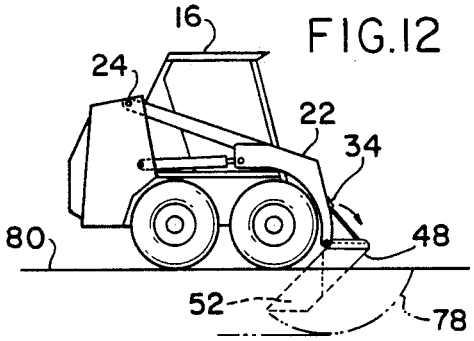
FIG.13
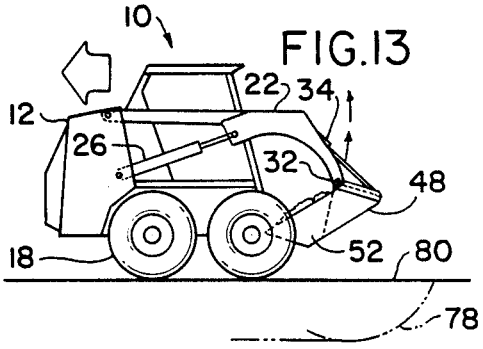

ATTACHMENT FOR TRACTOR

The present invention relates to improvements in converting a non-backhoeing tractor to achieve backhoeing service, and thereby obviating the need to use a specially designed, and correspondingly expensive and difficult to handle, backhoeing attachment.

As generally understood, a conventional attachment designed for backhoeing attaches to the front or back of a tractor and works on auxiliary hydraulics, that in turn control an independent free moving unit. This requires linkages, controls, and associated structure which is a significant expense, and is only as powerful as the auxiliary hydraulic powering source. Thus, backhoeing is usually only achieved using a backhoeing-designed unit.

EXAMPLE OF THE PRIOR ART

The U.S. Pat. No. 4,749,048 issued on Jun. 7, 1988 to Kelly is an effort to use a so-called "skid steer loader", and achieve a result resembling a backhoe-dug trench or hole. As described in Kelly, there is descending movement of the arms of the skid steer loader to place a scarifier in contact with the ground, and then backward movement of the skid steer loader is required to cause a scarifier tooth 13 to rip up asphalt, cement, frozen earth, etc.

SUMMARY OF THE INVENTION

In contrast to Kelly and all other known prior art, a front attachment is provided for a conventional tractor that effectively serves as a backhoe bucket. Underlying the present invention is the recognition that the hydraulic cylinder which provides a pivotal traverse which in a conventional operational mode causes "dumping" of the contents of a conventional tractor scoop attachment, is according to the present invention, used to advantage to power the within inventive tractor attachment through a backhoe stroke. Thus, without rearward tractor movement, a trench or hole is produced by backhoeing using a conventional non-backhoe designed front tractor attachment as is more specifically described herein.

The description of the invention which follows, together with the accompanying drawings should not be construed as limiting the invention to the example shown and described because those skilled in the art to which this invention appertains will be able to devise other forms thereof within the ambit of the appended claims.

BRIEF DESCRIPTION OF THE DRAWINGS

FIGS. 1 and 2 are side and front elevational views respectively of a conventional tractor used in conjunction with the within inventive attachment for same according to the present invention;

FIGS. 9 and 10 are reduced scale side views, similar to FIG. 1, showing in sequence how the attachment of FIG. 3 is attached to a tractor; and FIGS. 11, 12 and 13 are additional reduced scale side views, similar to FIGS. 9 and 10, but showing in sequence how the within inventive attachment is used for so-called "backhoeing" service.

DETAILED DESCRIPTION OF A PREFERRED EMBODIMENT

Figure 8:
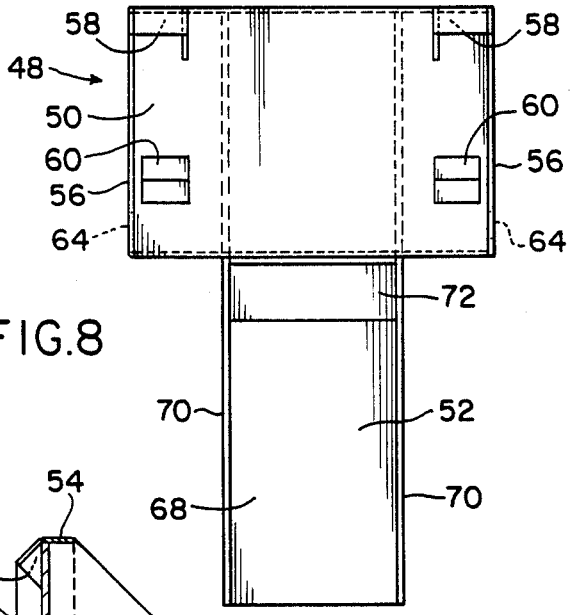
FIGS. 5, 6, 7 and 8 are respectively plan, front, bottom, and rear views of the attachment of FIG. 3.
Figure 5:
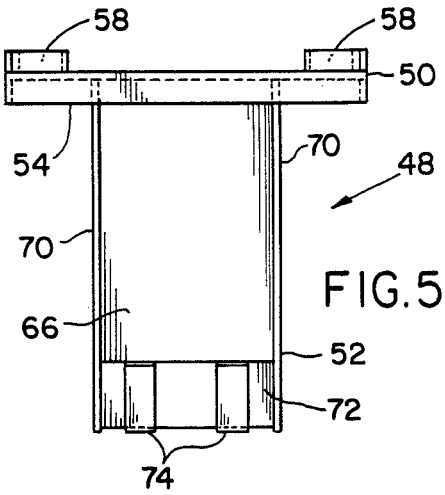

In FIGS. 1 and 2 is shown in popular type tractor 10 of the skid steer loader class, as exemplified by the tractor sold under the trademark BOBCAT by Melroe Company of Fargo, N. Dak. Characteristic of this class tractor is its adaptability for easy changeover to a number of fittings and attachments enabling vast versatility of the basic unit in performing a number of applications.

Tractor 10 consists generally of a main chassis 12 which houses power plant 14 and operator cab 16. Chassis 12 is supported on four wheels 18. Within cab 16 the operator uses a variety of levers and pedals to control tractor 10. Straddling the operator cab 16 is a trestle-like arm 22 which is pivoted vertically about a pivot axis 24 when activated by at least one, but preferably a pair, of a double acting hydraulic cylinder 26 for pivotal movement through an angle 28. On the distal end of arm 22 an attachment plate 30 is pivotally mounted at pivot axis 32. Plate 30 is activated by a double acting hydraulic cylinder 34 through angle 36. Cylinder 34 is attached at the middle of the cross member 38 on the trestle arm 22 and on the top center of attachment plate 30. Depending on the specific attachment that is applied to plate 30, arm 22 and cylinder 26 provide for an up-down degree of motion and cylinder 34 positions attachment plate 30 relative to arm 22 as determined by the operator's use of controls 20. The movement imparted particularly by cylinder 34 is significant to the beneficial and advantageous use of the within inventive tractor attachment, all as will be explained in greater detail subsequently.

Wheels 18 can, of course, be driven forward or in reverse, and turning of vehicle 10 is achieved by counter driving wheels 18 on opposite sides of tractor 10. That is, a turn to the left is executed by driving the right side wheels 18 forward and reversing the left side wheels 18, while a turn to the right is accomplished by reversing right side wheels 18 and driving left side wheels 18 in the forward direction.

On the outer ends of the top surface of plate 30, a pair of triangular shaped extensions or hooklike members 40 are provided to couple a desired attachment thereon. Further, a handle 42 is used to operate latch means 44 within plate 30. Rotation of handle 42 causes linkage 44 to extend locking tongues 46.

In FIGS. 3 through 8 are isolated views of an attachment to be applied to the aforementioned attachment plate 30 of tractor 10 and constitutes the crux of the invention. Nominally, the attachment or device, generally designated 48, is a backhoe bucket. While backhoe devices do exist for tractors, they are elaborate in construction, require auxiliary hydraulics, are expensive and are not easily interchanged with other functions, especially on the job site.

Figure 4:
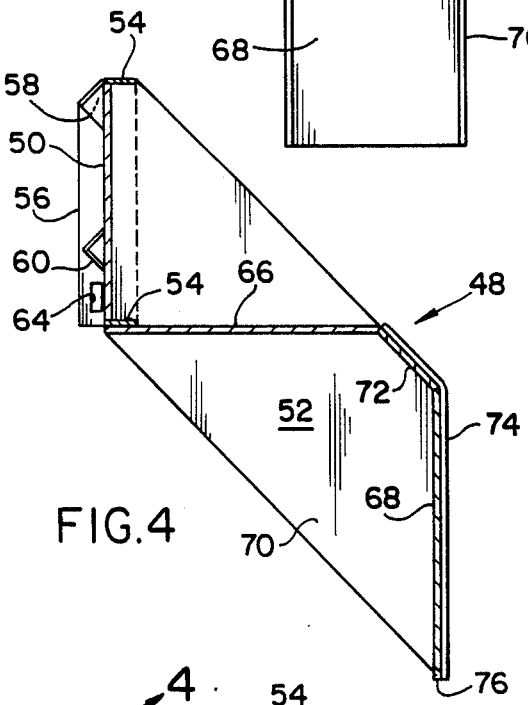
FIG. 4 is a sectional view of the attachment as taken along line 4—4 of FIG. 3.
Figure 7:
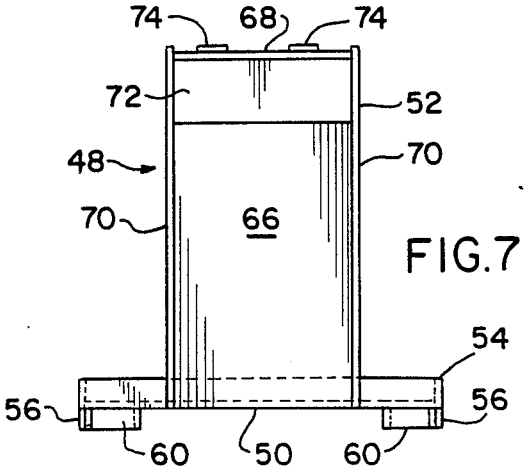

Describing first its construction, and then its adaptability for backhoeing, device 48, of steel welded construction, generally consists of mounting plate 50 and boxlike bucket 52 welded thereon. The vertically oriented mounting plate 50 is horizontally rectangular in shape and is surrounded by a marginal, forward extending lip or skirt 54. As shown in FIGS. 4, 7 and 8, a pair of rearward extending flanges 56, along each outboard edge of plate 50, form the outside walls of a pair of pockets 58. Pockets 58 are located to correspond to and to receive hooklike members 40 on attachment plate 30. Directly below pockets 58, a pair of stops 60 are provided to engage corresponding apertures 62 (FIG. 2) in the forward face of plate 30. Close to the bottom end of each flange 56 an aperture 64 is strategically located to receive a locking tongue 46 (FIG. 2) when plate 50 is flush against attachment plate 30 and linkage 44 reacts to rotation of handle 42. This action firmly locks the backhoe bucket device 48 to tractor unit 10, it being understood that locking methods for other brands of tractors are also within the contemplated scope of the present invention.

Figure 6:
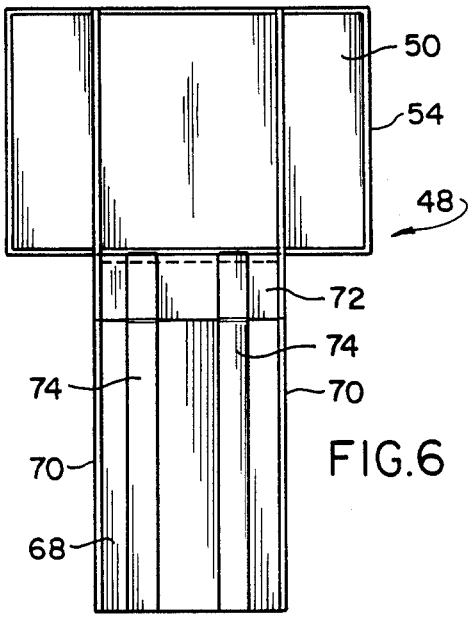
Figure 3:
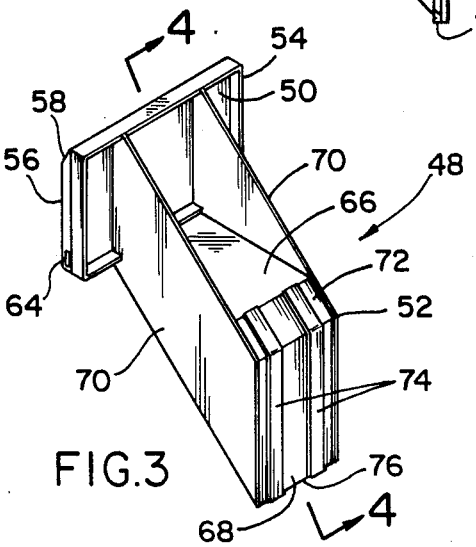
FIG. 3 is an isolated perspective view of the inventive tractor attachment.

To form the boxlike section 52 on the forward side of plate 50, a pair of diagonal walls 70 are welded to a horizontal plate member 66 together with a vertical plate member 68, all as best seen in FIGS. 3, 4 and 6. A small plate 72 is fastened in place to fill the diagonal gap between plates 66 and 68. On the outer surface (FIG. 3) of plates 68 and 72, a pair of steel straps are added for reinforcing and wear protection.

For on site attachment of device 48 to tractor 10, whatever was previously attached to plate 30 is first removed, exposing plate 30 in the horizontal orientation as shown in FIG. 9. Device 48 is oriented relative to tractor 10 as also shown in FIG. 9. The angular positions of arm 22 and plate 30 are maneuvered so that hook members 40 on plate 30 are just below the level of openings of pockets 58 on the rear side of plate 50. Tractor 10 is driven gently forward so that hooks 40 touch plate 50 and align with pockets 58. At this point, arm 22 is lifted slightly so that hooks 40 engage pockets 58 and plate 30 is rotated by withdrawal of the piston rod of cylinder 34 to the vertical position, thereby seating the hooks 40 in the pockets 58 by the weight of the bucket device 48. Stop members 60 on plate 50 automatically find their way within apertures 62 on plate 30. Handle 42 is now rotated to bring locking tongues 46 into apertures 64 in flanges 56.

When in use, and as best shown in FIG. 11, device 48 is maneuvered so that the bottom edge 76 of plate 68 is brought to bear on ground 80 near the far edge of the hole or ditch 78 to be dug. By lowering arm 22 and "wiggling" plate 30 via cylinder 34, edge 76 will initiate penetration into the soil. At a convenient initial penetration depth, cylinder 34 is then fully extended (FIG. 12) to achieve a backhoe stroke with bucket 52. Dirt within bucket 52 is retained as arm 22 is raised and device 48 clears the soil line 80 (FIG. 13). Tractor 10 is then backed away and dirt within bucket 52 is set aside by retracting cylinder 34.

Tractor 10 is then moved forward to repeat the cycle just described.

The significance of the operational mode as just descibed is that a tractor, not designed for backhoeing, is nevertheless effectively used for this purpose. Underlying the present invention is the recognition that the "dumping" pivotal traverse of cylinder 34 in the conventional operational mode of a non-backhoeing tractor can be used to advantage for the backhoeing stroke, which stroke is a pivotal traverse towards the tractor while the bucket edge 76 is engaged in the soil to be removed. In a conventional tractor operation, a scoop attachment is raised to the height of the cab 16 and cylinder 34 operated to pivotally traverse the scoop through a "dumping" movement, which is recognized as directionally also being towards the tractor when using the pivot axis as the reference. Thus, the same directional movement or traverse is advantageously used for backhoeing, together with the positioning of the tractor 10 so that the backhoe stroke is against the weight thereof, and, of course, designing the backhoe bucket 48 as a reversal of a conventional scoop so that the "dumping" stroke, as above explained, is a digging or backhoeing stroke.

While the particular backhoe bucket tractor attachment and backhoeing method herein shown and disclosed in detail is fully capable of attaining the objects and providing the advantages hereinabove stated, it is to be understood that it is merely illustrative of the presently preferred embodiment of the invention and that no limitations are intended to the detail of construction or design herein shown other than as defined in the appended claims.

What is claimed is:

1. A backhoeing device comprising a tractor having a rectangular mounting plate operatively disposed in a forward position therefrom, a first forwardly extending piston means from said tractor having a pivotal connection along a lower edge of said rectangular mounting plate so as to urge said mounting plate through ascending and descending movements, a second forwardly extending piston means from said tractor having a pivotal connection along an upper edge of said rectangular mounting plate so as to urge said mounting plate in pivotal traverse towards and away from said tractor, said tractor having an operative position in which it is stationary adjacent to a first side of an excavation site, and a backhoeing bucket attached in downwardly facing relationship on said mounting plate, said bucket including a vertically oriented mounting plate adapted to attach in an abutting manner with said rectangular mounting plate, said bucket mounting plate being affixed at its lower end to a bucket having a horizontal and vertical end wall members and a pair of parallel side walls, said end and side walls defining a generally trapezoidal inverted U shape bucket element having an open bottom and having an operative position adjacent a second opposite remote side of said excavation site, whereby incident to providing backhoeing service of said tractor said first piston means is adapted to initially lower said backhoeing bucket into contact with soil to be removed and said second piston means is adapted to thereupon urge said backhoeing bucket through a pivotal transverse towards said tractor and against the stationary weight thereof to thereby cause displacement of said soil from said excavation site into said backhoeing bucket.

2. A backhoeing device as claimed in claim 1 wherein said backhoeing bucket has plural apertures thereon and said mounting plate has plural hooks strategically located to engage by alignment in said aperatures, whereby the attachment of said backhoeing bucket on said mounting plate is achieved by maneuvering movements of said tractor in relation to said backhoeing bucket which results in the projection of said hooks into said apertures.

3. A backhoeing device as claimed in claim 2 wherein the edges of said backhoeing bucket bounding the opening thereinto have teeth therealong to facilitate the excavation of said contacted soil.

* * * * *